US006637388B2

(12) United States Patent
Fukuhara et al.

(10) Patent No.: US 6,637,388 B2
(45) Date of Patent: Oct. 28, 2003

(54) VALVE TIMING ADJUSTING DEVICE

(75) Inventors: Katsuyuki Fukuhara, Hyogo (JP); Mutsuo Sekiya, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/901,063

(22) Filed: Jul. 10, 2001

(65) Prior Publication Data

US 2001/0047781 A1 Dec. 6, 2001

Related U.S. Application Data

(63) Continuation of application No. PCT/JP99/06263, filed on Nov. 10, 1999.

(51) Int. Cl.[7] ..... F01L 1/344; F01L 13/00

(52) U.S. Cl. ..... 123/90.17; 74/568 R

(58) Field of Search ..... 123/90.15, 90.17, 123/90.31; 74/568 R; 464/1, 2, 160

(56) References Cited

U.S. PATENT DOCUMENTS

| | | | | |
|---|---|---|---|---|
| 5,836,277 A | | 11/1998 | Kira et al. | 123/90.17 |
| 5,845,615 A | * | 12/1998 | Nakamura et al. | 123/90.17 |
| 6,035,816 A | * | 3/2000 | Ogawa et al. | 123/90.17 |
| 6,039,015 A | * | 3/2000 | Sato | 123/90.17 |
| 6,039,016 A | * | 3/2000 | Noguchi | 123/90.17 |

FOREIGN PATENT DOCUMENTS

| | | |
|---|---|---|
| DE | 198 27 930 A1 | 1/1999 |
| DE | 199 18 910 A1 | 11/1999 |
| EP | 0 915 234 A2 | 5/1999 |
| GB | 945669 | 1/1964 |
| JP | 06-109181 | 4/1994 |
| JP | 09-060508 | 3/1997 |
| JP | 09-303118 | 11/1997 |
| JP | 10-339116 | 12/1998 |
| JP | 11-132015 | 5/1999 |
| JP | 11-141313 | 5/1999 |
| JP | 11-223112 | 8/1999 |
| JP | 11-311110 | 11/1999 |

* cited by examiner

*Primary Examiner*—Weilun Lo
(74) *Attorney, Agent, or Firm*—Sughrue Mion, PLLC

(57) ABSTRACT

A valve timing adjusting device has a lock mechanism for restricting a rotational motion of an internal rotor 7 relative to an external rotor 5. The lock mechanism has a plunger 45, which is movable along a radial direction of the external rotor 5 and restricts the rotational motion of the internal rotor 7 relative to the external rotor 5 on condition that the prevention of the rotational motion of the internal rotor 7 relative to the external rotor 5 is removable, a receiving hole 7*a*, which is arranged on an outer circumferential surface of the internal rotor 7 and receives the plunger 45, a spring 21, which presses the plunger 45 inwardly along the radial direction of the external rotor 5 by a prescribed pressure, a holder 46, which determines a position of the spring 21, and a knock pin 47 which prevents the holder 46 from being moved outwardly along the radial direction of the external rotor 5.

4 Claims, 5 Drawing Sheets

VALVE TIMING ADJUSTING DEVICE

CROSS-REFERENCE TO The RELATED APPLICATION

This application is a continuation of International Application No. PCT/JP99/06263, whose International filing date is Nov. 10, 1999, the disclosures of which Application are incorporated by reference herein, and which International Application was not published in English.

BACKGROUND OF THE INVENTION

1. Field of the Invention

The present invention relates to a valve timing adjusting device in which an open-close timing of a suction (or intake) valve or an exhaust valve of an engine is changed according to operation conditions of the engine.

2. Description of Related Art

A prior-art example of a vane type valve timing adjusting device is disclosed in the Published Unexamined Japanese Patent Application H9-303118 (1997). In this valve timing adjusting device, a cam shaft is driven with a timing pulley or a chain sprocket which is rotated in synchronization with the rotation of a crank shaft of an engine, and a suction valve or an exhaust valve is opened or closed according to a phase difference based on a rotational movement of the cam shaft relative to the timing pulley or the chain sprocket.

FIG. 1 to FIG. 3 are drawings respectively showing a vane type conventional valve timing adjusting device. FIG. 1 is a vertical sectional view of the valve timing adjusting device, and FIG. 2 and FIG. 3 are respectively sectional views taken substantially along line A—A of FIG. 1. FIG. 2 shows the valve timing adjusting device set in a position condition in which a cam shaft is placed at a maximally spark-lag (or timing-retarded) position in phase with respect to the rotation of a timing pulley, and FIG. 3 shows the valve timing adjusting device set in a position condition in which a cam shaft is placed at a maximally spark-advance (or timing-advance) position in phase with respect to the rotation of a timing pulley. In FIG. 1, 1 indicates a valve timing adjusting device. 2 indicates a cam shaft for a suction valve. The cam shaft 2 is rotatably supported by a cylinder head (not shown). As shown in FIG. 1, a timing pulley 3 is arranged on a top portion of the cam shaft 2 to receive a rotational force of a crank shaft (not shown) of an engine through a belt or chain. An external rotor 5 is integrally fixed to the timing pulley 3 by using a plurality of bolts 4 to prevent a rotational movement of the timing pulley 3 relative to the external rotor 5. A cover 6 is fixed to one end of the external rotor 5 by using the bolts 4. In an internal opening of the external rotor 5, an internal rotor 7 is arranged. A length of the internal rotor 7 in an axial direction of the cam shaft 2 is almost equal to that of the external rotor 5. The internal rotor 7 is integrally fitted to the top portion of the cam shaft 2 by a bolt 9 so as to place the timing pulley 3 between a protruding portion 8 of the cam shaft 2 and the internal rotor 7. In the inside of the cam shaft 2, a spark-advance oil passage 10 and a spark-lag oil passage 11 are formed by drilling work so as to extend in the axial direction of the cam shaft 2. The spark-advance oil passage 10 and the spark-lag oil passage 11 lead to an oil supply source (not shown) through an oil supply channel 12 and an oil discharge channel 13 which are arranged in a cylinder head (not shown).

As shown in FIG. 2 and FIG. 3, on the inner circumferential side of the external rotor 5, five pressure chambers 15 and a supporting hole 16 are formed. The five pressure chambers 15 are partitioned by a plurality of portioning walls (or a plurality of shoes) 14 of the external rotor 5, and the supporting hole 16 extends in a radial direction of the external rotor 5. A leading hole 17 is arranged in near to the center of the bottom of the supporting hole 16, and a diameter of the leading hole 17 is smaller than that of the supporting hole 16. A slide pin 18 is inserted into the leading hole 17. A slide pin supporting portion 19 is integrally formed with the slide pin 18 so as to be formed into the bottom portion of the slide pin 18. A ring member 20 is fixedly attached to the outer circumferential surface of the supporting hole 16, and a spring 21 is arranged in a position between the slide pin supporting portion 19 and the ring member 20 so as to press the slide pin 18 toward the inner circumferential side of the external rotor 5. Here, the ring member 20 is inserted into the supporting hole 16 with a fixed force or is screwed to the outer circumferential surface of the supporting hole 16 to be fixed in the supporting hole 16. Therefore, the ring member 20 functions as a supporting seat to fix one end of the spring 21 at a prescribed position.

On the outer circumferential surface of the inner rotor 7, five vanes 22 are fitted to the inner rotor 7 so as to be placed in the five pressure chambers 15 respectively. Each vane 22 can be rotated in a circle-circumferential direction of the cam shaft 2 in the corresponding pressure chamber 15, and the vanes 22 divide the five pressure chambers 15 into a group of spark-advance hydraulic oil chambers 23, 24, 25, 26 and 27 and a group of spark-lag hydraulic oil chambers 28, 29, 30, 31 and 32. An oil pressure in each spark-advance hydraulic oil chamber 23, 24, 25, 26 or 27 is adjusted by oil supplied or discharged through the spark-advance oil passage 10 and a spark-advance oil passage 33, 34, 35, 36 or 37. Also, an oil pressure in each spark-lag hydraulic oil chamber 28, 29, 30, 31 or 32 is adjusted by oil supplied or discharged through the spark-lag oil passage 11 and a spark-lag oil passage 38, 39, 40, 41 or 42. 43 indicates a receiving hole. arranged in the internal rotor 7. The slide pin 18 can be inserted into the receiving hole 43. 44 indicates an oil passage leading to the receiving hole 43. The oil passage 44 leads to the spark-advance oil passage 10 and the spark-advance oil passages 33, 34, 35, 36 and 37.

Next, an operation is described.

In the position condition shown in FIG. 2, the cam shaft 2 is placed at a maximally spark-lag position with respect to the rotation direction of the timing pulley 3 shown by an arrow of FIG. 2. When the timing pulley 3 is rotated with a crank shaft (not shown), the rotational-force of the timing pulley 3 is transmitted to the cam shaft 2, which can not rotate relative to the timing pulley 3, through the slide pin 18, and the cam shaft 2 is rotated in the rotation direction indicated by the arrow of FIG. 2.

Here, the phase of each vane 22 can be changed in the rotation direction of the cam shaft 2, and information relating to a rotation frequency in an engine and a driving power of the engine is sent to a control circuit (not shown). Therefore, in cases where it is judged in the control circuit that the advance of the cam shaft 2 in phase with respect, to the rotation of the timing pulley 3 is preferred, oil is supplied to the spark-advance oil passage 10, oil of the spark-lag oil passage 11 is discharged, and the phase of the cam shaft 2 with respect to the timing pulley 3 is changed. More precisely, a control valve (not shown) leading to both the oil supply channel 12 and the oil. discharge channel 13 is controlled so as to supply oil to the spark-advance oil passage 10. The oil supplied to the spark-advance oil passage 10 flows into the oil passage 44, and the oil pushes the top portion of the slide pin 18 against the resilient force of the spring 21. In the position condition shown in FIG. 2, the top end of the spark-advance oil passage 33 does not lead to the spark-advance hydraulic oil chamber 23, and the top end of the spark-advance oil passage 37 does not lead to the spark-advance hydraulic oil chamber 27. Therefore, the oil pressure in the oil passage 44 is necessarily increased by the oil which is supplied from the spark-advance oil passages 34, 35 and 36 to the spark-advance hydraulic oil chambers 24, 25 and 26 respectively, the slide pin 18 is pushed out from the receiving hole 43, and each vane 22 moved with the cam shaft 2 is rotated in the rotation direction indicated by the arrow of FIG. 2. When the cam shaft 2 is rotated by a prescribed angle, the top ends of the spark-advance oil passages 33 and 37 lead to the spark-advance hydraulic oil chambers 23 and 27, and the oil is supplied to the spark-advance hydraulic oil chambers 23 and 27. In contrast, the oil placed in the spark-lag hydraulic oil chambers 28, 29, 30, 31 and 32 is discharged through the spark-lag oil passages 38, 39, 40, 41 and 42 and the spark-lag oil passage 11. Therefore, each vane 22 is rotated and moved to the maximally spark-advance position shown in FIG. 3 by using an oil pressure difference between both hydraulic oil chambers placed on the both sides of the vane 22. Thus the cam shaft 2 is advanced in phase with respect to the rotation of the timing pulley 3.

In contrast, in cases where it is desired to move the cam shaft 2 to a spark-lag position in phase with respect to the rotation of the timing pulley 3, oil is supplied in an opposite direction to move each vane 22 placed in the maximally spark-advance position shown in FIG. 3 to the maximally spark-lag position shown in FIG. 2. In detail, the control valve (not shown) is controlled so as to supply oil from the spark-lag oil passage 11 to the spark-lag hydraulic oil chambers 28, 29, 30, 31 and 32 through the spark-lag oil passages 38, 39, 40, 41 or 42, and the oil placed in the spark-advance hydraulic oil chambers 23, 24, 25, 26 and 27 is discharged through the spark-advance oil passages 33, 34, 35, 36 and 37 and the spark-advance oil passage 10. Therefore, each vane 22 is rotated and moved to the maximally spark-lag position shown in FIG. 2 by using an oil pressure difference between both hydraulic oil chambers placed on the both sides of the vane 22. In this position condition, when the timing pulley 3 is rotated, the slide pin 18, which is pushed by the spring 21 toward the cam shaft 2, is inserted into the receiving hole 43, and rotation of the cam shaft 2 relative to the timing pulley 3 is prevented.

However, in the conventional valve timing adjusting device, the ring member 20 is inserted into the supporting hole 16 with a fixed force or is screwed to the outer circumferential surface of the supporting hole 16 to be fixed in the supporting hole 16. Therefore, for example, the fitting of the ring member 20 to the outer circumferential surface of the supporting hole. 16 may easily become loosened because of a failure in the press fitting of the ring member 20. Otherwise the fitting of the ring member 20 may easily become loosened because of both a temperature change and a difference in a coefficient of linear thermal expansion between the ring member 20 and the external rotor 5, or the screwed connection of the ring member 20 with the outer circumferential surface of the supporting hole 16 is easily loosened because of vibration. As a result, the position of the ring member 20 is shifted, and the spring 21, which gives the resilient force toward a shaft center of the valve timing adjusting device, is set to an unnecessarily prolonged length. Therefore, the resilient force of the spring 21 is lowered, and there is probability that the slide pin 18 comes out from the receiving hole 43. In this case, even though it is required to prevent the rotational motion of the inner rotor 7 relative to the external rotor 5, there is probability that the prevention of the rotational motion of the inner rotor 7 relative to the external rotor 5 is impossible. Also, in extreme cases, there is probability that the ring member 20 comes out from the supporting hole 16. In this case, there is probability that complete failure is caused in the valve timing adjusting device.

SUMMARY OF THE INVENTION

An object of the present invention is to provide, with due consideration to the drawbacks of the conventional valve timing adjusting device, a valve timing adjusting device in which a preventing means for preventing a position change in a holding means such as the ring member 20 is arranged to ensure prevention of detachment of the holding means and to ensure prevention of a position change of the holding means. The preventing means functions as a relative rotational motion preventing means to reliably prevent rotational motion of the inner rotor 7 relative to the external rotor 5 and to reliably remove the prevention of the relative rotational motion.

A valve timing adjusting device according to the present invention comprises a first rotation member which has a plurality of shoes and is arranged so as to be rotatable around a cam shaft, a second rotation member which has a plurality of vanes, is arranged in an internal hole of the first rotation member, is arranged to allow rotational motion relative to the first rotation member within a prescribed angle range and is fixed to the cam shaft, a spark-lag hydraulic oil chamber and a spark-advance hydraulic oil chamber which are respectively arranged between each vane of the second rotation member and the corresponding shoe of the first rotation member, and a lock mechanism for preventing the rotational motion of the second rotation member relative to the-first rotation member while being operated along a radial direction of the first rotation member. The lock mechanism comprises a restricting means, which is movable in the radial direction of the first rotation member, for restricting the rotational motion of the second rotation member relative to the first rotation member on condition that the prevention of the rotational motion of the second rotation member relative to the first rotation member is removable, a receiving hole, which is arranged on an outer circumferential surface of the second rotation member, for receiving the restricting means, a force giving means forgiving the restricting means a force which is directed inwardly along the radial direction of the first rotation member, a holding means for positioning the force giving means, and a preventing means for preventing the holding means from being moved outwardly along the radial direction of the first rotation member. Therefore, the preventing. means can prevent the holding means from moving outwardly along the radial direction of the first rotation member. Also, the preventing means can prevent the force giving means from moving outwardly along the radial direction of the first rotation member. Therefore, the preventing means can prevent the restricting means from early detaching from the receiving hole when the rotational motion of the second rotation member relative to the first rotation member is prevented, the slide pin 18 can be reliably caught by a receiving hole 43 if necessary. Accordingly, the rotational motion of the second rotation member relative to the first rotation member can be reliably prevented.

Also, in the valve timing adjusting device according to the present invention, the preventing means, for example, using a knock pin is arranged in the first rotation member along an axial direction of the first rotation member, and a top end of the preventing means is caught by the holding means. In this case, because the preventing means is caught by the holding means, the holding means and the restricting means can be easily prevented from being moved outwardly along the radial direction of the first rotation member.

Also, in the valve timing adjusting device according to the present invention, the holding means has a smaller diameter portion at an outside position along the radial direction of the first rotation member, the holding means has an uneven portion composed of the smaller diameter portion and a larger diameter portion adjacent to the smaller diameter portion, a top portion of the preventing means is caught by the uneven portion. In this case, because the preventing means is caught by the uneven portion, the holding means and the restricting means can be easily, prevented from being moved outwardly along the radial direction of the first rotation member.

Also, in the valve timing adjusting device according to the present invention, one end of the preventing means, which penetrates through the first rotation member in an axial direction of the first rotation member, is supported to allow rotational motion of the preventing means relative to the cam shaft and is caught by a third rotation member, and the other end of the preventing means is caught by the holding means. In this case, when a positioning means for determining a relative position of the third rotation member to the first rotation member is used as the restricting means, the holding means and the restricting means can be easily prevented from being moved outwardly along the radial direction of the first rotation member.

Also, in the valve timing adjusting device according to the present invention, the first rotation member has both a receiving hole, which extends in the radial direction of the first rotation member and receives the holding means, and a circular shaped groove which is formed on an inner wall surface of the receiving hole, and the preventing means is formed of a nearly-annular member, of which a part is cut out, and can be tightly fitted in the circular shaped groove. In this case, because the preventing means, which is tightly fitted in the circular shaped groove of the first rotation member and is fixed to the first rotation member, can come in contact with the holding means, the holding means and the restricting means can be easily prevented from being moved outwardly along the radial direction of the first rotation member.

Also, in the valve timing adjusting device according to the present invention, the first rotation member has both a receiving hole, which extends in the radial direction of the first rotation member and receives the holding means, and a circular shaped groove which is formed on an inner wall surface of the receiving hole, the holding means has a protruding portion which protrudes outwardly along the radial direction of the first rotation member, and the preventing means is formed of a disk-shaped member which has both an outer end portion caught by the circular shaped groove of the first rotation member and a center opening from which the protruding portion of the holding means is received. In this case, the protruding portion of the holding means penetrates through the center opening of the restricting means, and the outer end portion of the preventing means is caught by the circular shaped groove of the first rotation member. Therefore, when the protruding portion of the holding means is pushed inwardly along the radial direction of the first rotation member while the deformation of the preventing means is maintained, the holding means is deformed and inserted into the preventing means, and the shape of the preventing means is returned to a nearly original shape. Therefore, the holding means and the restricting means can be easily prevented from being moved outwardly along the radial direction of the first rotation member.

Also, in the valve timing adjusting device according to the present invention, the preventing means is formed of an annular cover with which an outer circumferential surface of the first rotation member is covered, and an inner circumferential surface of the annular cover comes in contact, with the holding means. In this case, when the annular cover of the first rotation member is used as the preventing means, the holding means and the restricting means can be easily prevented from being moved outwardly along the radial direction of the first rotation member.

Also, in the valve timing adjusting device according to the present invention, the preventing means is formed of a skirt portion of an nearly-tubular cover member with which both the first rotation member and the second rotation member are covered, and an inner circumferential surface of the skirt portion of the nearly-tubular cover member comes in contact with the holding means. In this case, when the nearly-tubular cover member is used as the preventing means, the holding means and the restricting means can be easily prevented from being moved outwardly along the radial direction of the first rotation member.

Also, in the valve timing adjusting device according to the present invention, the first rotation member has a receiving hole which extends in the radial direction of the first rotation member and receives the holding means, and the preventing means comprises both a first screw portion, which is arranged on an outer circumferential surface of the holding means according to a rolling operation, and a second screw portion which is arranged on an inner circumferential surface of the receiving hole according to the rolling operation and is connected with the first screw portion. In this case, because the second screw portion is connected with the first screw portion, the holding means and the restricting means can be easily prevented from being moved outwardly along the radial direction of the first rotation member.

Also, in the valve timing adjusting device according to the present invention, the preventing means further comprises adhesive with which a space between the first screw portion and the second screw portion is coated. In this case, because a screw-connection plane between the first screw portion and the second screw portion is coated with the adhesive, the holding means and the restricting means can be easily prevented from being moved outwardly along the radial direction of the first rotation member.

DETAILED DESCRIPTION OF THE PREFERRED EMBODIMENTS

The invention will now be described with reference to the accompanying drawings.

Embodiment 1

Figure 1:
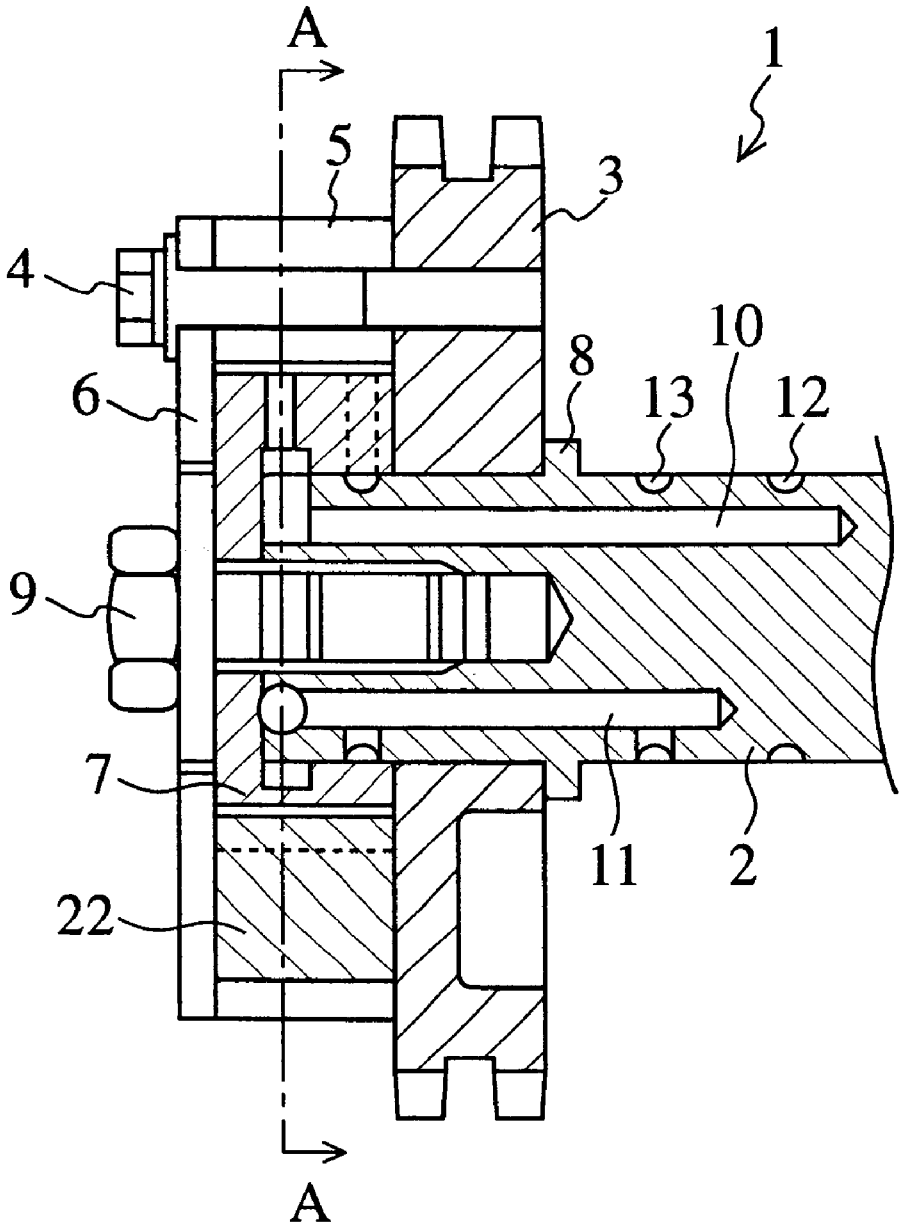
FIG. 1 (PRIOR ART)
FIG. 1 is a vertical sectional view of a vane type conventional valve timing adjusting device.
Figure 2:
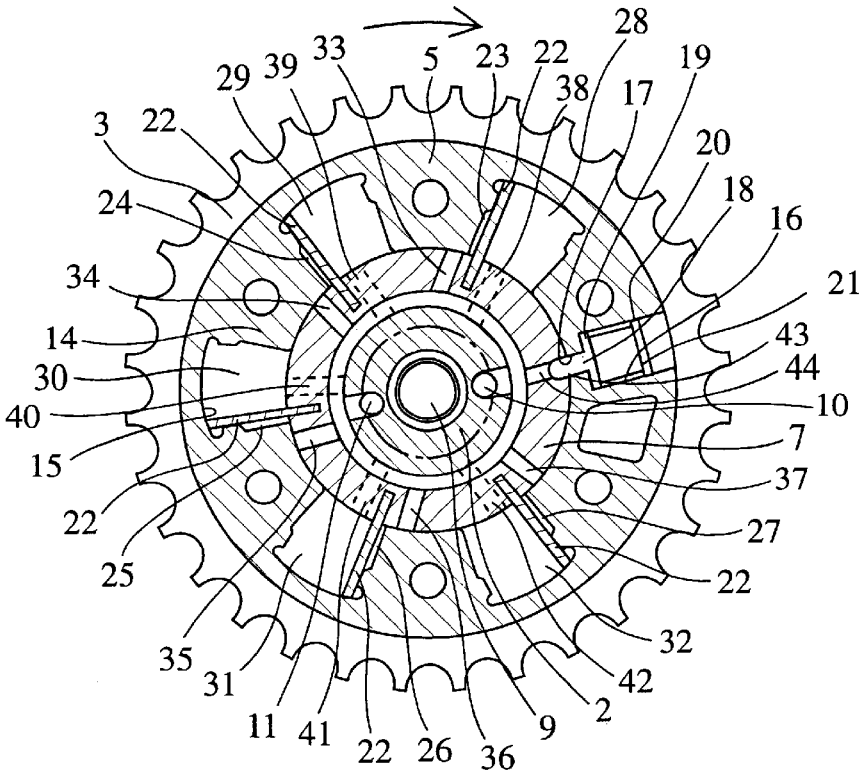
FIG.2 (PRIOR ART)
FIG. 2 is a sectional view taken substantially along line A—A of FIG. 1 in a position condition in which a cam shaft is placed at a maximally spark-lag position in phase with respect to the rotation of a timing pulley.
Figure 3:
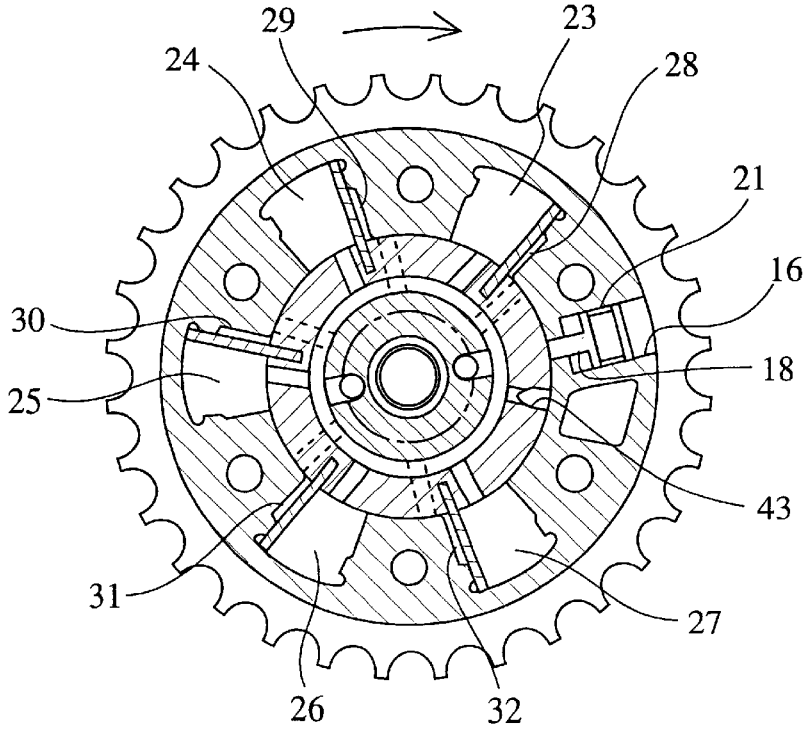
FIG.3 (PRIOR ART)
FIG. 3 is a sectional view taken substantially along line A—A of FIG. 1 in a position condition in which a cam shaft is placed at a maximally spark-advance position in phase with respect to the rotation of a timing pulley.
Figure 4:
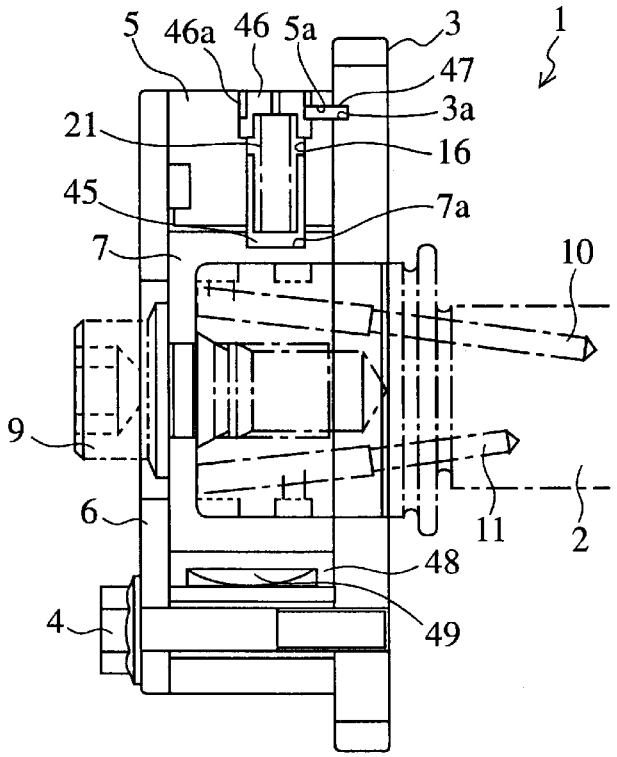
FIG. 4 is a vertical sectional view showing an important part of a valve timing adjusting device according to a first embodiment of the present invention.

FIG. 4 is a vertical sectional view showing an important part of a valve timing adjusting device according to a first embodiment of the present invention. In constituent elements of the valve timing adjusting device according to the first embodiment, the constituent elements, which are the same as those of the conventional valve timing adjusting device shown in FIG. 1, are indicated by the same reference numerals as those used in FIG. 1, and the description of such constituent elements is omitted.

In FIG. 4, 7*a* indicates a receiving hole which is formed on the inward side of the outer circumferential surface of the inner rotor (or second rotation member) 7 along a radial direction of the inner rotor 7. The diameter of the receiving hole 7*a* is the same as that of the supporting hole 16 of the external rotor (or first rotation member) 5, and the receiving hole 7*a* leads to an oil control valve (not shown) through an oil passage (not shown). In the supporting hole 16, a plunger 45 is arranged so as to be able to slide on the inner surface of the supporting hole 16. The plunger 45 functions as a restricting means for restricting a rotational motion of the internal rotor 7 relative to the external rotor 5. A holder 46 is arranged in the supporting hole 16 as a holding means. A spring (or a force giving means) 21 is arranged between the plunger 45 and the holder 46. The plunger 45 is pushed by the spring 21 inwardly along the radial direction of the external rotor 5. The holder 46 is formed in a nearly cylindrical shape and has an uneven portion 46*a* which is composed of both a larger diameter portion placed at an inner position in the radial direction of the external rotor 5 and a smaller diameter portion placed at an outer position in the radial direction of the external rotor 5. In the external rotor 5, a penetrating hole 5*a* penetrating from the supporting hole 16 to a plane of the external rotor 5 (that is, a plane coming in contact with the timing pulley 3) along an axial direction of the external rotor 5 is formed, and a knock pin 47 functioning as a preventing means is inserted into the penetrating hole 5*a*. One end of the knock pin 47 comes in contact with the uneven portion 46*a* of the holder 46 in the supporting hole 16, so that the holder 46 is prevented by the knock pin 47 from being moved. outwardly along the radial direction of the external rotor 5. Also, the other end of the knock pin 47 is inserted into a hole 3*a* of the timing pulley (or third rotations member) 3 to determine a relative position of the timing pulley 3 to the external rotor 5.

A lock mechanism according to the first embodiment comprises the plunger 45, the receiving hole 7*a*, the spring 21, the holder 46 and the knock pin 47. Here, 48 indicates a chip seal, and 49 indicates a back spring formed of a plate spring. The back spring 49 pushes the chip seal 48 so as to come in contact with the internal rotor 7.

Next, an operation is described.

In cases where it is desired to move the cam shaft 2 to a spark-lag position with respect to the rotation direction of the timing pulley 3, oil is supplied from an oil supply source (not shown) to the spark-lag hydraulic oil chamber adjacent to each vane, and oil is discharged from the spark-advance hydraulic oil chamber adjacent to the vane. Therefore, each vane is rotated and moved to the maximally spark-lag position while using an oil pressure difference between both the hydraulic oil chambers placed on the both sides of the vane. In this position condition, when the timing pulley 3. is rotated, the plunger 45, which is pushed by the spring 21 toward the cam shaft 2, is inserted into the receiving hole 7*a* of the internal rotor 7, rotational motion of the cam shaft 2, which is fixed to the internal rotor 7, relative to the timing pulley 3, which is fixed to the external rotor 5 by the knock pin 47, is prevented.

In the conventional valve timing adjusting device, in cases where temperature or vibration of an engine undergoes considerable variation due to increases or decreases in a rotation speed of the engine or a load on the engine,the fitting of the ring member 20 is easily loosened because of a difference in coefficient of linear thermal expansion between the ring member 20 and the external rotor 5, or the screw connection of the ring member 20 is easily loosened. As a result, the position of the ring member 20 is shifted, and the resilient force of the spring 21 is lowered. In this case, even though a relative movement between the external rotor 5 and the internal rotor 7 is set to be restricted, the plunger 45 becomes detached from the internal rotor 7, and there is possibility that a rotational motion of the cam shaft 2 relative to the timing pulley 3 cannot be prevented. Also, in the worst case, the ring member 20 comes out from the supporting hole 16, and there is possibility that complete component failure is caused in the conventional valve timing adjusting device.

However, in the valve timing adjusting device according to the first embodiment, even though a holding force for the holder 46 is lowered because of the influence of heat or vibration and a centrifugal force on the plunger 45 and the like is added, the holder 46, in which the spring 21 pushing the plunger 45 is held in the supporting hole 16, can be prevented from being moved outwardly along the radial direction of the external rotor 5. Accordingly, though the plunger 45 is not prevented from slightly moving outwardly due to the centrifugal force along the radial direction of the external rotor 5 against the resilient force of the spring 21, because the holder 46 is prevented from being moved outwardly along the radial direction of the external rotor 5 and the spring 21 is contracted, the detachment of the plunger 45 from the receiving hole 7*a* can be reliably prevented.

In the first embodiment, the knock pin 47 functions as a preventing pin for preventing the plunger 45 from being moved outwardly along the radial direction of the external rotor 5 and functions as a positioning pin for determining a relative position of the external rotor 5 to the timing pulley 3. Therefore, the number of parts in the valve timing adjusting device can be reduced as compared with a case where a pin is used for each function, and the weight and cost of the valve timing adjusting device can be reduced. However, it is applicable that the knock pin 47 be used only as a preventing pin and another part be used as a positioning pin.

Also, in the first embodiment, the uneven portion 46*a* is arranged in the holder 46, and one end of the knock pin 47 comes in contact with the uneven portion 46*a* to prevent the holder 46 from being moved outwardly along the radial direction of the external rotor 5. However, the end of the knock pin 47 can come in contact with any plane of the holder 46 on condition that the plane of the holder 46 is one of planes facing on the outer side in the radial direction of the external rotor 5.

Also, in the first embodiment, the larger diameter portion and the smaller diameter portion are arranged in the holder 46 as the uneven portion 46*a* in the axial direction of the holder 46 to arrange a corner for the contact with the knock pin 47. However, even though the holder 46 has only one diameter in its axial direction, it is applicable that a groove for the contact with the knock pin 47 be formed substantially in the center of the outer surface of the holder 46 in the axial direction of the holder 46 so as to extend all around the holder 46.

Embodiment 2

Figure 5:
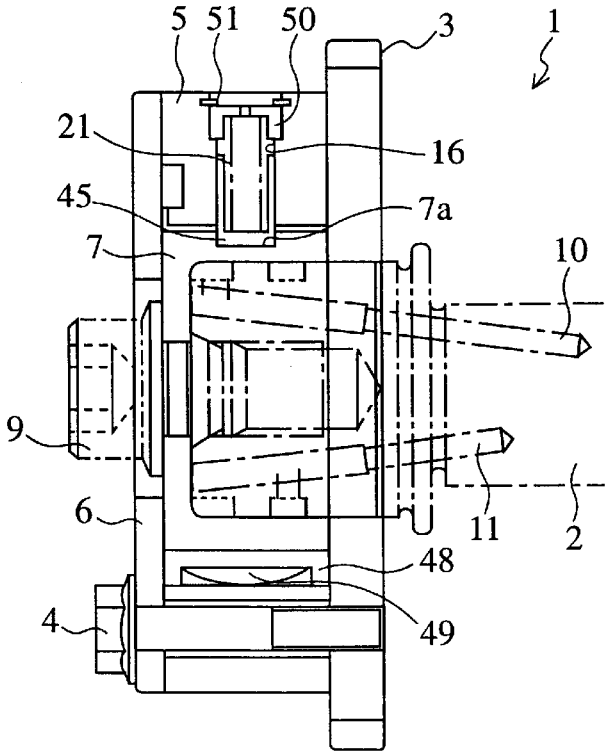
FIG. 5 is a vertical sectional view showing an important part of a valve timing adjusting device according to a second embodiment of the present invention.

FIG. 5 is a vertical sectional view showing an important part of a valve timing adjusting device according to a second embodiment of the present invention. In constituent elements of the valve timing adjusting device according to the second embodiment, the constituent elements, which are the same as those of the valve timing adjusting device of the first embodiment shown in FIG. 4, are indicated by the same reference numerals as those used in FIG. 4, and the description of the constituent elements is omitted.

Features of a valve timing adjusting device according to the second embodiment are as follows. A holder (a holding means) 50 formed in a tubular shape and having a bottom is arranged in the supporting hole 16 functioning as an arranging hole. A nearly-annular member (a preventing means) 51 formed in a nearly annular shape is tightly fitted in a circular shaped groove (not shown) which is formed on the inner circumferential surface of the supporting hole 16. The nearly-annular member 51 is detachable from the circular shaped groove of the supporting hole 16. A lock mechanism comprises the holder 50, the nearly-annular member 51, the plunger 45, the receiving hole 7*a* and the spring 21. Therefore, as shown in FIG. 5, because the nearly-annular member 51 is tightly fitted in the circular shaped groove (hot shown) of the supporting hole 16, the holder can be reliably prevented by the nearly-annular member 51 from being moved outwardly along the radial direction of the external rotor 5. Accordingly, though the plunger 45 is not prevented from slightly moving outwardly due to the centrifugal force along the radial direction of the external rotor 5 against the resilient force of the spring 21, because the holder 46 is prevented from being moved outwardly along the radial direction of the external rotor 5 and the spring 21 is contracted, the detachment of the plunger 45 from the receiving hole 7*a* can be reliably prevented.

It is applicable that the circular shaped groove (not shown) be formed all around the inner circumferential surface of the supporting hole 16. Also, it is applicable that the circular shaped groove (not shown) be formed in a position corresponding to the shape of the nearly-annular member 51 on the inner circumferential surface of the supporting hole 16. Also, it is not required to form the nearly-annular member 51 out of a material having a perfectly annular shape. That is, by considering a fitting workability, it is preferable that the nearly-annular member 51 be formed in a C-ring shape or an E-ring shape. However, the second embodiment is not limited to the nearly-annular member 51 formed in a C-ring shape or an E-ring shape.

In the second embodiment, the outer diameter of the nearly-annular member 51 is larger than the inner diameter of the supporting hole 16 by two times of a depth of the circular shaped groove (not shown). Therefore, the nearly-annular member 51 is deformable so as to pass through the supporting hole 16, and the nearly-annular member 51 is flexible to immediately return the deformed shape of the nearly-annular member 51 to the original shape. Therefore, it is preferable that the nearly-annular member 51 be formed out of a flexible material such as metal, plastic or the like.

Embodiment 3

Figure 6:
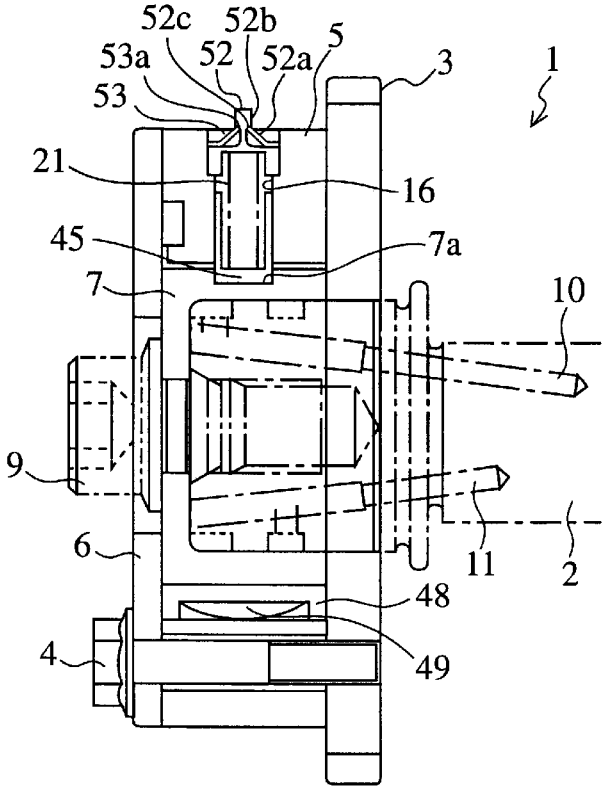
FIG. 6 is a vertical sectional view showing an important part of a valve timing adjusting device according to a third embodiment of the present invention.

FIG. 6 is a vertical sectional view, showing an important part of a valve timing adjusting device according to a third embodiment of the present invention. In constituent elements of the valve timing adjusting device according to the third embodiment, the constituent elements, which are the same as those of the valve timing adjusting device of the first or second embodiment shown in FIG. 4 or FIG. 5, are indicated by the same reference numerals as those used in FIG. 4 or FIG. 5, and the description of such constituent elements is omitted.

Features of a valve timing adjusting device according to the third embodiment are as follows. A holder 52 has an uneven portion 52*a* which is composed of a larger diameter portion, a middle diameter portion and a smaller diameter portion. The larger diameter portion of the uneven portion 52*a* is placed on the inner side in the radial direction of the external rotor 5, the middle diameter portion of the uneven portion 52*a* is placed on the outer side in the radial direction of the external rotor 5, and the smaller diameter portion of the uneven portion 52*a* is placed between the larger diameter portion and the middle diameter portion to connect the larger diameter portion and the middle diameter portion. A protruding portion 52*b* is composed of the middle diameter portion and the smaller diameter portion of the uneven portion 52*a* . The holder 52 is arranged in the supporting hole 16. A nut member (or a preventing means) 53 formed substantially in the shape of a disk has a center opening 53*a* into which the protruding portion 52*b* of the holder 52 can be inserted. A lock mechanism comprises the holder 52, the nut member 53, the plunger 45, the receiving hole 7*a* and the spring 21. The outer end portion of the nut member 53 can be tightly fitted in a circular shaped groove (not shown) which is formed on the inner circumferential surface of the supporting hole 16. When the protruding portion 52*b* of the holder 52 is inserted into the center opening 53*a* of the nut member 53, the inner end portion of the nut member 53 facing the center opening 53*a* is caught by the uneven portion 52*a* of the holder 52. Thereafter, when the top portion of the protruding portion 52*b* of the holder 52 is pushed inwardly along the radial direction of the external rotor 5, the outer end portion of the nut member 53 is tightly fitted in the circular shaped groove of the supporting hole 16. Thereafter, when the top portion of the protruding portion 52*b* of the holder 52 is furthermore pushed inwardly along the radial direction of the external rotor 5, a center portion formed in the protruding portion 52*b* of the holder 52 is pushed down inwardly along the radial direction of the external rotor 5 until the shape of the nut member 53 is returned to an original flat shape. To smoothly deform the nut member 53 during the pushing of the-protruding portion 52*b* of the holder 52, a cut-out portion 52*c* is formed in the center portion formed in the protruding portion 52*b* of the holder 52.

In the third embodiment, the nut member 53 functioning as the preventing means is deformed in advance before the nut member 53 is fitted to the holder 52, the protruding portion 52*b* of the holder 52 is pushed down so as to return the shape of the nut member 53 to its original flat shape, and the holder 53 is fixed in the supporting hole 16. That is, a so-called push-nut structure is adopted. Therefore, unless the uneven portion 52*a* of the holder 52 is broken, the holder 52 can be reliably prevented from being moved outwardly along the radial direction of the external rotor 5. Accordingly, the plunger 45 is not prevented from slightly moving outwardly due to the centrifugal force along the radial direction of the external rotor 5 against the resilient force of the spring 21, because the holder 52 is prevented from being moved outwardly along the radial direction of the external rotor 5 and the spring 21 is contracted, the detachment of the plunger 45 from the receiving hole 7*a* can be reliably prevented.

Embodiment 4

Figure 7:
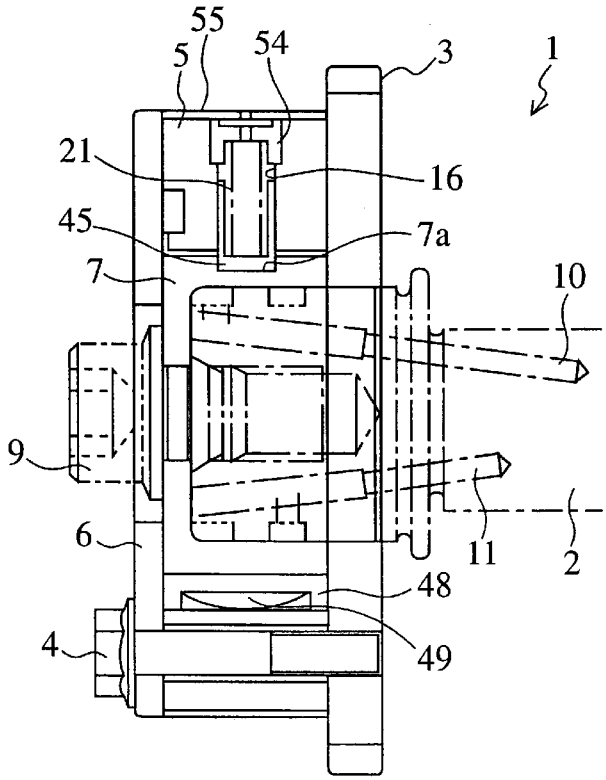
FIG. 7 is a vertical sectional view showing an important part of a valve timing adjusting device according to a fourth embodiment of the present invention.

FIG. 7 is a vertical sectional view showing an important. part of a valve timing adjusting device according to a fourth embodiment of the present invention. In constituent elements of the valve timing adjusting device according to the fourth embodiment, the constituent elements, which are the same as those of the valve timing adjusting device of the first, second or third embodiment, are indicated by the same reference numerals as those used in the first, second or third embodiment, and the description of such constituent elements is omitted.

Features of a valve timing adjusting device according to the fourth embodiment are as follows. A holder 54 having a nearly cylindrical shape is arranged in the supporting hole 16. The outer circumferential surface of the external rotor 5 is covered with an annular cover (or a preventing means) 55, and the inner circumferential surface of the annular cover 55 comes in contact with the holder 54. A lock mechanism comprises the holder 54, the annular cover 55, the plunger 45, the receiving hole 7*a* and the spring 21.

To prevent the holder 54 from being moved outwardly along the radial direction of the external rotor 5 by using the inner circumferential surface of the annular cover 55, as shown in FIG. 7, it is required to set the position of the holder 54 in the supporting hole 16 so as to make both the outer side surface of the holder 5 in the radial direction of the external rotor 5 and the outer circumferential surface of the external rotor 5 form a nearly flat plane. Therefore, because the position of the holder 54 is set as is described above, the holder 54 can be prevented from being moved outwardly along the radial direction of the external rotor 5. Accordingly, though the plunger 45 is not prevented from slightly moving outwardly due to the centrifugal force along the radial direction of the external rotor 5 against the resilient force of the spring 21, because the holder 54 is prevented from being moved outwardly along the radial direction, of the external rotor 5 and the spring 21 is contracted, the detachment of the plunger 45 from the receiving hole 7*a* can be reliably prevented.

In the fourth embodiment, the inner circumferential surface of the annular cover 55 functioning as a protecting member of the external rotor 5 is used as the preventing means. However, the fourth embodiment is not limited to this configuration. For example, it is applicable that a protruding portion (not shown) be arranged at a prescribed position of the inner circumferential surface of the annular cover 55 and the protruding portion be put into the supporting hole 16 so as to come in contact with the holder 54. Therefore, the holder 54 can be prevented from being moved outwardly along the radial direction of the external rotor 5.

Embodiment 5

Figure 8:
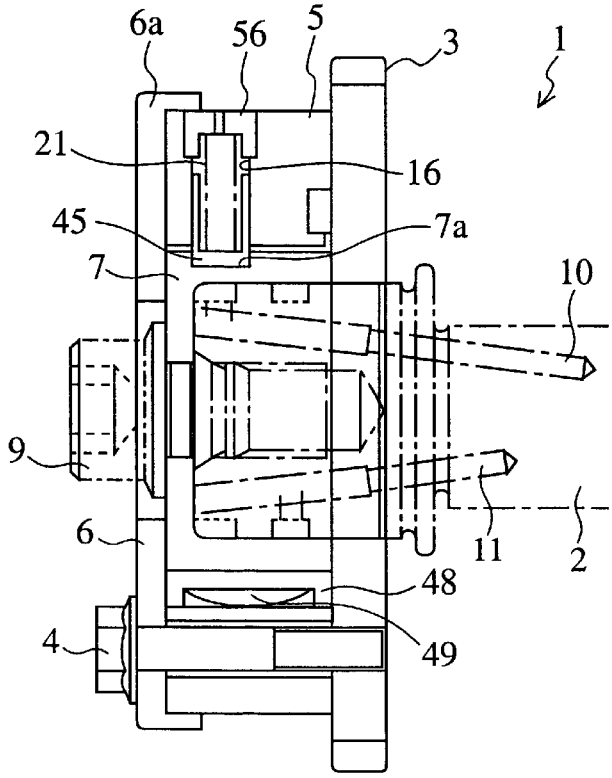
FIG. 8 is a vertical sectional view showing an important part of a valve timing adjusting device according to a fifth embodiment of the present invention.

FIG. 8 is a vertical sectional view showing an important part of a valve timing adjusting device according to a fifth embodiment of the present invention. In constituent elements of the valve timing adjusting device according to the fifth embodiment, the constituent elements, which are the same as those of the valve timing adjusting device of the first, second, third or fourth embodiment, are indicated by the same reference numerals as those used in the first, second, third or fourth embodiment, and the description of such constituent elements is omitted.

Features of a valve timing adjusting device according to the fifth embodiment are as follows. A holder 56 is formed in a tubular shape and has a bottom. The cover 6 has a skirt portion (or a preventing means) 6*a* , and the inner circumferential surface of the skirt portion 6*a* of the cover 6 comes in contact with the outer side surface of the holder 56 in the radial direction of the external rotor 5. A lock mechanism comprises the holder 56, the cover 6, the plunger 45, the receiving hole 7*a* and the spring 21. Therefore, as shown in FIG. 8, the holder 56 can be prevented from being moved outwardly along the radial direction of the external rotor 5 by using the cover 6 which protects the external rotor 5 and a portion of the internal rotor 7. Accordingly, though the plunger 45 is not prevented from slightly moving outwardly due to the centrifugal force along the radial direction of the external rotor 5 against the resilient force of the spring 21, because the holder 56 is prevented from being moved outwardly along the radial direction of the external rotor 5 and the spring 21 is contracted, the detachment of the plunger 45 from the receiving hole 7*a* can be reliably prevented.

Embodiment 6

Figure 9:
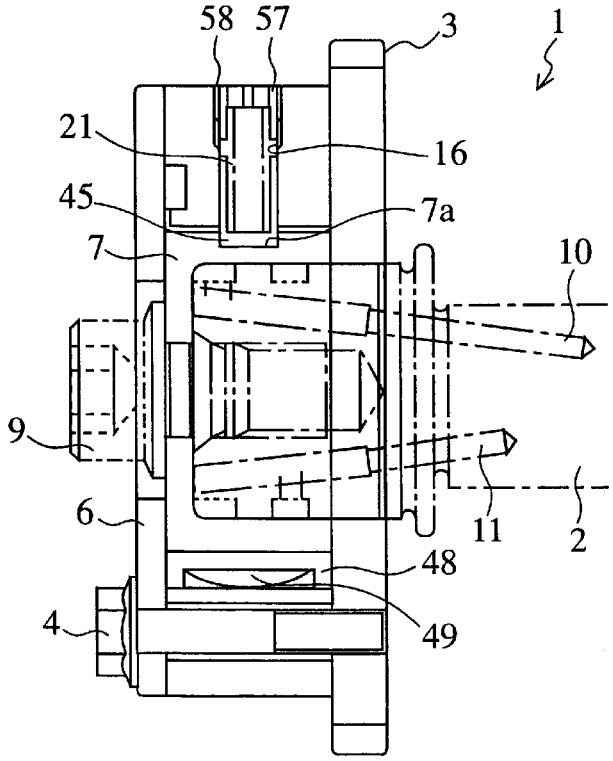
FIG. 9 is a vertical sectional view showing an important part of a valve timing adjusting device according to a sixth embodiment of the present invention.

FIG. 9 is a vertical sectional view showing an important part of a valve timing adjusting device according to a sixth embodiment of the present invention. In constituent elements of the valve timing adjusting device according to the sixth embodiment, the constituent elements, which are the same as those of the valve timing adjusting device of the first, second, third, fourth or fifth embodiment, are indicated by the same reference numerals as those used in the first, second, third, fourth or fifth embodiment, and the description of such constituent elements is omitted.

Features of a valve timing adjusting device according to the sixth embodiment are as follows. A holder 57 is formed in a tubular shape and has a bottom, and a first screw portion (not shown) is formed on the outer circumferential surface of the holder 57 according to a rolling operation. Also, a second screw portion (not shown) is formed on a part of the inner circumferential surface of the supporting hole 16 according to the rolling operation so as to be connected with the first screw portion of the holder 57. Therefore, the holder 57 is screwed to the inner circumferential surface of the supporting hole 16. A lock mechanism comprises the holder 57, the screw portions, the plunger 45, the receiving hole 7*a* and the spring 21. Therefore, as shown in FIG. 9, the holder 57 can be prevented from being moved outwardly along the. radial direction of the external rotor 5. Accordingly, though the plunger 45 is not prevented from slightly moving outwardly due to the centrifugal force along the radial direction of the external rotor 5 against the resilient force of the spring 21, because the holder 57 is prevented from being moved outwardly along the radial direction of the external rotor 5 and the spring 21 is contracted, the detachment of the plunger 45 from the receiving hole 7*a* can be reliably prevented.

In the sixth embodiment, the holder 57 is screwed to the inner circumferential surface of the supporting hole 16. However, there is probability that the connection of the screw portions is loosened because of vibration. Therefore, to reliably fix the connection of the screw portions, it is applicable that an adhesive layer 58 be arranged between the screw portions.

As is described above, in the valve timing adjusting device according to the present invention, a restricting means for restricting a rotational motion of a second rotation member relative to a first rotation member on condition that the prevention of the, rotational motion of the second rotation member relative to the first rotation member is removable, a force giving means for giving a force to the restricting means, a holding means for positioning the force giving means and a preventing means for preventing the holding means from being moved outwardly along a radial direction of the first rotation member are provided. Therefore, when the rotational motion of the second rotation member relative to the first rotation member is restricted, the movement of the holding means can be reliably prevented. Accordingly, a cam shaft fixed to the second rotation member and a timing pulley fixed to the first rotation member can be reliably rotated in synchronization with each other. That is, the valve timing adjusting device is useful for the changing of an open-close timing of a suction valve or an exhaust valve in an engine.

What is claimed is:

1. A valve timing adjusting device, comprising:

a first rotation member which has a plurality of shoes and is arranged so as to be rotatable around a cam shaft;

a second rotation member which has a plurality of vanes, is arranged in an internal hole of the first rotation member, is arranged to allow rotational motion relative to the first rotation member within a prescribed angle range and is fixed to the cam shaft;

a timing-retarded hydraulic oil chamber and a timing-advance hydraulic oil chamber which are respectively arranged between each vane of the second rotation member and the corresponding shoe of the first rotation member; and a lock mechanism for preventing the rotational motion of the second rotation member relative to the first rotation member, the lock mechanism being operable along a radial direction of the first rotation member, the lock mechanism comprising:

a supporting hole provided in a radial direction of the first rotation member, the supporting hole being formed on an outward side of the inner circumferential surface of the first rotation member;

a plunger that is adapted to be slidably inserted into the supporting hole;

a receiving hole provided in a radial direction of the second rotation member, the receiving hole being formed on an inward side of the outer circumferential surface of the second rotation member and being adapted to align with the supporting hole;

a holder positioned in the supporting hole of the first rotation member and located on the outer side of an outer circumferential surface of the first rotation member;

an elastic member provided between the plunger and the holder;

a penetrating hole provided in an axial direction of the first rotation member to connect the supporting hole with an external surface of the first rotation member; and a knock pin located in the penetrating hole and adapted to contact the holder.

2. The valve timing adjusting device according to claim 1, wherein the holder is cylindrical-shaped and has a grooved portion that engages the knock pin.

3. The valve timing adjusting device according to claim 1, wherein the penetrating hole is located on the outer side of the outer circumferential surface of the first rotation member proximate to the holder.

4. A valve timing adjusting device, comprising:

a first rotation member which has a plurality of shoes and is arranged so as to be rotatable around a cam shaft;

a second rotation member which has a plurality of vanes, is arranged in an internal hole of the first rotation member, is arranged to allow rotational motion relative to the first rotation member within a prescribed angle range and is fixed to the cam shaft;

a timing-retarded hydraulic oil chamber and a timing-advance hydraulic oil chamber which are respectively arranged between each vane of the second rotation member and the corresponding shoe of the first rotation member; and a lock mechanism for preventing the rotational motion of the second rotation member relative to the first rotation member, the lock mechanism being operable along a radial direction of the first rotation member, the lock mechanism comprising:

restricting means, which is movable in the radial direction of the first rotation member, for restricting the rotational motion of the second rotation member relative to the first rotation member on condition that the prevention of the rotational motion of the second rotation member relative to the first rotation member is removable;

receiving hole, which is arranged on an outer circumferential surface of the second rotation member, for receiving the restricting means;

force giving means for giving the restricting means a force which is directed inwardly along the radial direction of the first rotation member;

holding means for positioning the force giving means; and preventing means for preventing the holding means from being moved outwardly along the radial direction of the first rotation member;

wherein the preventing means is arranged in the first rotation member along an axial direction of the first rotation member, and a first end of the preventing means engages the holding means;

wherein a second end of the preventing means is supported so as to enable rotational motion of the first rotation member relative to the cam shaft, wherein the second end engages a third rotation member.

* * * * *